United States Patent [19]

Lopez

[11] Patent Number: 4,599,799

[45] Date of Patent: Jul. 15, 1986

[54] ELECTRIC STIPPLER WITH LOBED CAM-DISK DRIVE

[76] Inventor: Ruben M. Lopez, 235 Quentin Rd. -3C, Brooklyn, N.Y. 11223

[21] Appl. No.: 639,234

[22] Filed: Aug. 9, 1984

[51] Int. Cl.[4] ..... B43L 13/00; B43L 13/24

[52] U.S. Cl. ..... 33/18.2; 33/39 R; 33/39.1; 81/9.2

[58] Field of Search ..... 33/18 R, 18 B, 32 B, 33/39 R; 81/9.2, 9.22

[56] References Cited

U.S. PATENT DOCUMENTS

| | | | |
|---|---|---|---|
| 464,801 | 12/1891 | O'Reilly | 81/9.22 |
| 2,337,341 | 12/1943 | Miller et al. | 33/18 R X |
| 2,346,474 | 4/1944 | De La Torre | 81/9.2 X |
| 2,467,083 | 4/1949 | Francis | 33/18 R X |
| 2,701,417 | 2/1955 | Graham | 33/18 R |
| 2,832,140 | 4/1958 | Gaines | 33/39 A X |
| 3,325,902 | 6/1967 | Schuman | 33/18 B |
| 3,509,786 | 5/1970 | Buttner | 81/9.22 |
| 3,638,319 | 2/1972 | Barlow et al. | 33/18 R |
| 4,204,438 | 5/1980 | Binaris et al. | 81/9.22 |

FOREIGN PATENT DOCUMENTS

| | | | |
|---|---|---|---|
| 251652 | 10/1912 | Fed. Rep. of Germany | 33/18 B |
| 821833 | 9/1937 | France | 33/18 B |
| 843870 | 4/1939 | France | 33/18 B |
| 23327 | of 1901 | United Kingdom | 33/18 B |
| 173628 | 1/1922 | United Kingdom | 33/18 B |

*Primary Examiner*—Robert S. Ward

*Attorney, Agent, or Firm*—Nicholas J. Garofalo

[57] ABSTRACT

A draftsman's stippling device, small enough to be manually held during use, includes a vibratable cantelever bar supported in a small housing and having a free end projecting to the outside on which end a stippling pen is mounted. A cam disk having lobes about its periphery is adapted to be rotated by means of a battery powered mini-motor and reduction gearing at high speed against the upper surface of the bar. The lobes on the spinning cam disk successively depress the bar against the opposing tension of a return spring, whereby the bar and pen rapidly vibrate as a unit to enable stippling of a drawing surface disposed below the pen.

5 Claims, 4 Drawing Figures

ELECTRIC STIPPLER WITH LOBED CAM-DISK DRIVE

This invention is concerned with an electric stippling device having a vibratable stippling pen operable by a minimotor. The device is small in size and adapted to be held in in the hand during use. It is especially suitable for use by draftsmen in providing stippling in drawings, such as in shading or in depicting sectional views of various materials.

Presently, a draftsman provides stippling to a drawing surface by holding a pen with his fingers and vibrating his hand to repeatedly bring the tip of the pen against the drawing surface. This mode of stippling is time consuming, becomes tiresome when prolonged, and often results in undesirable results.

The general object of the present invention is to provide for the draftsman an electric stippling device which is simple and practical in structure, is small enough to be held in the user's hand, is efficient in its mode of operation, and which overcomes the various disadvantages associated with the present method used by draftsmen in stippling drawings.

The stippling device of the present invention includes a small housing in which a battery powered motor is operable to vibrate a cantelever bar having a draftsman's pen mounted to a free end of the bar externally of the housing. Because of its simple structure, the device is light in weight and small enough to be held in the draftsman's hand during use. In using the device, the draftsman, after setting a switch to energize the motor, manually moves the device over a drawing surface to allow the vibrating pen to stipple the drawing.

DESCRIPTION OF PREFERRED EMBODIMENT

Figure 1:
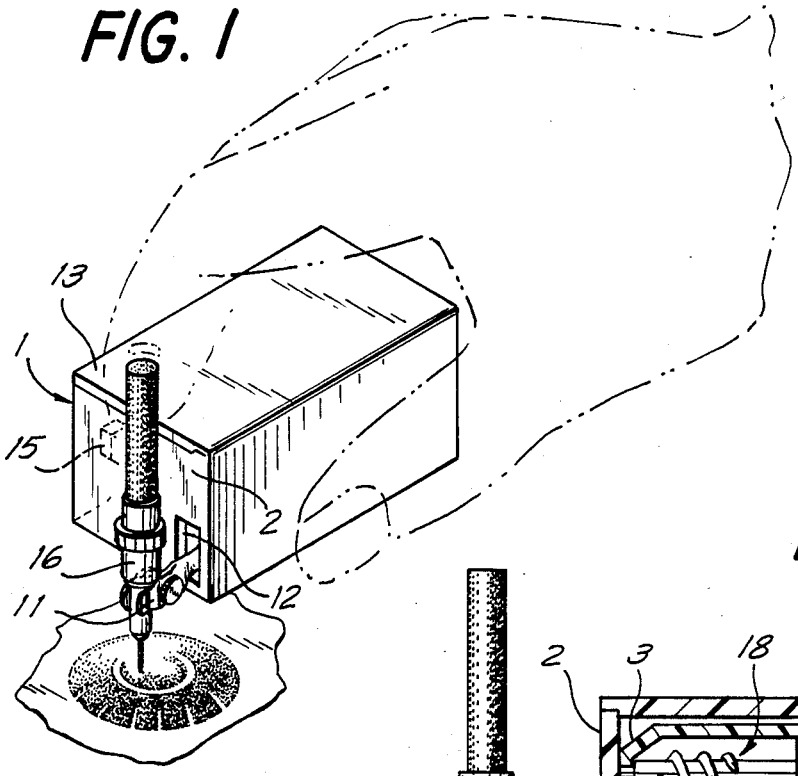
FIG. 1 is an isometric view of an electric stippling device embodying the invention, the device being shown in a stippling operation.
Figure 2:
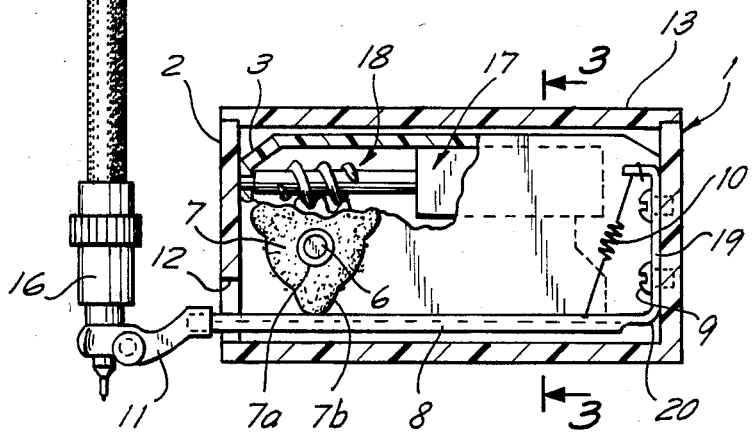
FIG. 2 is a longitudinal section through the device taken on line 2—2 of FIG. 3, a portion being broken away to show portions of the motor and gearing.
Figure 4:
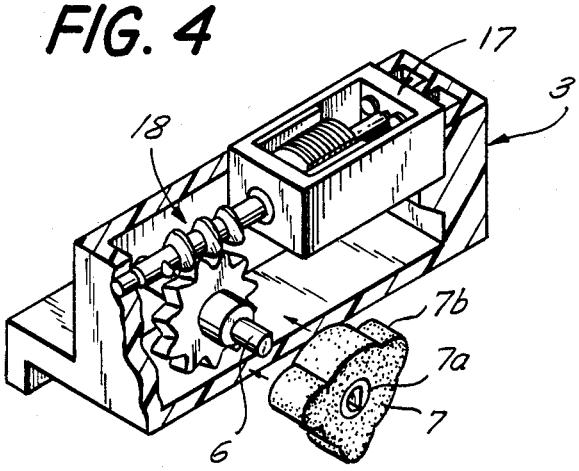
FIG. 4 is a detail view showing the gearing operatively connecting the motor with the cam disk drive shaft.
Figure 3:
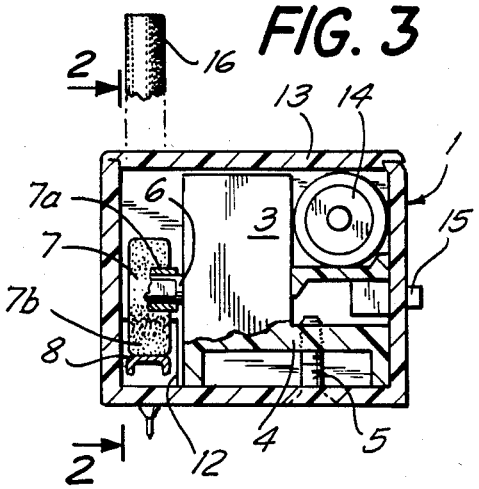
FIG. 3 is a cross section taken on line 3—3 of FIG. 2.

The stippling device of the present invention includes a box defining a housing 1. Access to the Interior of the housing is provided through a top opening normally closed by a lid 13. Disposed withing the housing is a mini-motor 17, the output shaft of which is connected by reduction gearing 18 to a shavt 6. The motor and gearing are confined in a dust proof box 3 anchored within the housing by means of a screw 5. Shaft 6 projects out of the box 3. Mounted on shaft 6 for rotation with the latter is a cam disk 7.

The cam disk has a plurality of lobes *7b* spaced equally about its periphery. Here, the lobes are three in number. A bushing *7a* fixed axially of the body of the cam disk is press fitted upon shaft 6. For reasons, as will later appear herein, the body of the cam disk is thick and is formed of a soft resilient sponge material, such as latex rubber. The body is also lightly lubricated.

An elongated cantelever bar 8 is disposed horizontally within the housing beneath the periphery of the cam disk. The bar terminates at its rear in an upright piece 19, which is fixed by screws 9 to the inner face of a rear wall of the housing. A forward end of the bar projects freely through a vertical slot 12 in a front wall 2 of the housing to the outside. Attached to the forward end of the bar is a drafting pen holder 11 in which a stippling pen 16 is clamped. The pen has a vertical position in the holder with its tip pointing downward.

The bar 8 has a flat upper surface; and a channel extends substantially the length of its underside. The channel provides a desirable strength to the bar. Rearwardly of the channeled portion is a short curved section 20 of the bar adjoining the upright piece 19. The curved section allows flexing of the bar angularly in a vertical plane. A return spring 10, engaged at its lower end to the bar and hooked at its upper end to a fixed support, constantly tensions the bar upwardly against the periphery of the cam disk.

The motor is powered by a battery 14 seated within the housing. The circuit contacts for the battery and the associated wiring with the motor are conventional and not shown in the drawing. An on-off switch 15 in the battery circuit to the motor is mounted to the housing.

The overall size of the device is small enough to enable the device to be held in the hand of the draftsman during use, as indicated in FIG. 1. When the switch is moved to the "on" position, the motor is energized, and a high torque is transmitted by it through the gearing and shaft 6 to spin the cam disk 7. The lobes *7b* of the spinning cam disk successively abut and flex the bar downwardly against the opposing tension of the return spring 10; and as each lobe moves away from the bar, the spring returns the bar upwardly against the periphery of the cam disk. This cooperating action of the multi-lobed spining cam disk and the return spring upon the bar results in a rapid vibrating action of the bar and drafting pen as a unit.

Here the cam disk revolves at 300 RPM. While spinning at this rate of speed, the three lobed cam disk causes the bar to vibrate the drafting pen 900 times per minute. This enables the device to effect 900 stipple dots per minute onto a drawing surface.

When using the device to stipple a drawing surface, the draftsman manually holds the device above and sufficiently close to the drawing surface to allow the tip of the vibrating pen to contact it. While maintaining this close proximity of the device to the drawing surface, the draftsman moves the device about as needed to effect the desired stippling. It is apparent that a draftsman can, by using the device, produce a considerable number of stippled drawings in a relatively short time.

The soft resilient material of the cam disk is of advantage in the stippling operation. Due to it, a gentle vibratory action is imparted to the bar so as to allow the tip of the pen to gently contact the drawing surface. In addition, the light lubrication applied to the body of the cam disk enables the latter to ride over the bar with a minimum of friction.

What is claimed is:

1. An electric stippler for use by draftsmen, the stippler comprising: a housing, the housing being of small size adapted to be held in the hand of the draftsman during use of the stippler, a cantelever bar disposed within the housing in a horizontal position between a top wall and a bottom wall of the housing, the bar having a rear end fixed to a support within the housing and having a forward free end projecting freely through a vertical slot in a front wall of the housing, a stippling pen fixed to the free end and having a tip extending downward, the bar and pen as a unit being vibratable relative to the fixed end of the bar, a battery energizable mini-motor within the housing, and means operatively associated with the mini-motor for imparting vibration to the bar and pen as a unit.

2. An electric stippler for use by draftsmen as in claim 1, wherein the means operatively associated with the mini-motor for imparting vibration to the bar and pen as a unit comprises a rotatable cam disk having a plurality of lobes spaced equally about its periphery, a rotatable shaft upon which the cam disk is axially mounted for rotation with the shaft, reduction gearing drivingly connecting the mini-motor with the shaft for transmitting high torque to the shaft, and spring means constantly tensioning the bar upwardly against the periphery of the cam disk, the lobes on the cam disk being adapted upon rotation of the cam disk to successively ride over and depress the bar downwardly against the tension of the spring means, and the spring means being adapted to return the bar upwardly against the periphery of the cam disk following the depressing action of each lobe.

3. An electric stippler for use by draftsmen as in claim 2, wherein the cam disk has a body of soft resilient material, the body is lightly lubricated, a bushing is contained axially of the body, and the bushing is press fitted upon the shaft.

4. An electric stippler for use by draftsmen as in claim 2, wherein the cam disk has a body of latex rubber, a bushing is contained axially of the body and is press fitted upon the shaft, and the body is lightly lubricated whereby the lobes are adapted to be resiliently compressed upon engagement with the bar and to ride over the bar with reduced friction.

5. An electric stippler for use by draftsmen as in claim 3, wherein the lobes on the cam disk are three in number, and the reduction gearing is adapted to transmit the torque of the mini-motor to revolve the cam disk at 300 RPM.

* * * * *